US009291041B2

(12) United States Patent
Alifano et al.

(10) Patent No.: US 9,291,041 B2
(45) Date of Patent: Mar. 22, 2016

(54) DOWNHOLE INJECTOR INSERT APPARATUS

(71) Applicant: Orbital ATK, Inc., Dulles, VA (US)

(72) Inventors: Joseph A. Alifano, Commack, NY (US); Daniel Tilmont, Rocky Point, NY (US); Sean C. Peiffer, Patchogue, NY (US)

(73) Assignee: Orbital ATK, Inc., Dulles, VA (US)

( * ) Notice: Subject to any disclaimer, the term of this patent is extended or adjusted under 35 U.S.C. 154(b) by 443 days.

(21) Appl. No.: 13/832,992

(22) Filed: Mar. 15, 2013

(65) Prior Publication Data

US 2014/0216737 A1 Aug. 7, 2014

Related U.S. Application Data

(60) Provisional application No. 61/761,629, filed on Feb. 6, 2013.

(51) Int. Cl.
*E21B 43/00* (2006.01)
*E21B 43/12* (2006.01)
*E21B 43/24* (2006.01)

(52) U.S. Cl.
CPC ..... *E21B 43/122* (2013.01); *E21B 43/121* (2013.01); *E21B 43/123* (2013.01); *E21B 43/24* (2013.01)

(58) Field of Classification Search
CPC ..... E21B 43/121–43/124; E21B 43/24
USPC ..... 166/58, 89
See application file for complete search history.

(56) References Cited

U.S. PATENT DOCUMENTS

| | | | |
|---|---|---|---|
| 2,642,889 | A | 6/1953 | Cummings |
| 2,803,305 | A | 8/1957 | Behning et al. |
| 3,407,830 | A | 10/1968 | Reagan |
| 3,426,786 | A | 2/1969 | Canalizo |
| 3,456,721 | A | 7/1969 | Smith |
| 3,482,630 | A | 12/1969 | Earlougher, Jr. |
| 4,237,973 | A | 12/1980 | Todd |
| 4,243,098 | A | 1/1981 | Meeks et al. |
| 4,336,839 | A | 6/1982 | Wagner et al. |
| 4,377,205 | A | 3/1983 | Retallick |
| 4,380,267 | A | 4/1983 | Fox |
| 4,385,661 | A | 5/1983 | Fox |
| 4,390,062 | A | 6/1983 | Fox |
| 4,397,356 | A | 8/1983 | Retallick |
| 4,411,618 | A | 10/1983 | Donaldson et al. |
| 4,421,163 | A | 12/1983 | Tuttle |

(Continued)

OTHER PUBLICATIONS

PCT International Search Report, Application No. PCT/US2014/010834, dated Nov. 11, 2014, three (3) pages.

(Continued)

*Primary Examiner* — Robert E Fuller
*Assistant Examiner* — Steven MacDonald
(74) *Attorney, Agent, or Firm* — TraskBritt

(57) ABSTRACT

An injector insert apparatus includes a body that has an inner oil passage that is configured and arranged to allow oil to pass therethrough. The body further has an annular chamber formed around the inner oil passage. The annular chamber has a chamber opening that is configured to be coupled to receive a flow of thermal gas medium. The body also has at least one injector orifice that provides a passage between the annular chamber and the inner oil passage. The at least one injector orifice is configured to inject the thermal gas medium into oil passing through the inner oil passage.

15 Claims, 5 Drawing Sheets

(56) References Cited

U.S. PATENT DOCUMENTS

| | | | | |
|---|---|---|---|---|
| 4,431,069 | A | 2/1984 | Dickinson, III et al. | |
| 4,442,898 | A | 4/1984 | Wyatt | |
| 4,458,756 | A | 7/1984 | Clark | |
| 4,463,803 | A | 8/1984 | Wyatt | |
| 4,471,839 | A | 9/1984 | Snavely et al. | |
| 4,498,531 | A | 2/1985 | Vrolyk | |
| 4,502,535 | A * | 3/1985 | Kofahl | E21B 36/006 165/105 |
| 4,522,263 | A | 6/1985 | Hopkins et al. | |
| 4,558,743 | A | 12/1985 | Ryan et al. | |
| 4,648,835 | A | 3/1987 | Eisenhawer et al. | |
| 4,682,471 | A | 7/1987 | Wagner | |
| 4,699,213 | A | 10/1987 | Fleming | |
| 4,718,489 | A | 1/1988 | Hallam et al. | |
| 4,783,585 | A | 11/1988 | Meshekow | |
| 4,805,698 | A | 2/1989 | Baugh et al. | |
| 4,834,174 | A | 5/1989 | Vandevier | |
| 5,033,545 | A * | 7/1991 | Sudol | B08B 9/035 134/167 C |
| 5,052,482 | A | 10/1991 | Gondouin | |
| 5,211,230 | A | 5/1993 | Ostapovich et al. | |
| 5,339,897 | A | 8/1994 | Leaute | |
| 5,525,044 | A | 6/1996 | Chen | |
| 5,623,576 | A | 4/1997 | Deans | |
| 5,775,426 | A | 7/1998 | Snider et al. | |
| 6,959,760 | B1 | 11/2005 | Braithwaite et al. | |
| 7,493,952 | B2 | 2/2009 | Ayasse | |
| 7,497,253 | B2 | 3/2009 | Retallick et al. | |
| 7,628,204 | B2 | 12/2009 | Iqbal et al. | |
| 7,640,987 | B2 | 1/2010 | Kalman et al. | |
| 7,665,525 | B2 | 2/2010 | Pfefferle | |
| 7,712,528 | B2 | 5/2010 | Langdon et al. | |
| 7,784,533 | B1 | 8/2010 | Hill | |
| 7,946,342 | B1 | 5/2011 | Robertson | |
| 8,091,625 | B2 | 1/2012 | Ware et al. | |
| 2007/0235197 | A1 * | 10/2007 | Becker | E21B 43/122 166/372 |
| 2007/0284107 | A1 | 12/2007 | Crichlow | |
| 2008/0017381 | A1 | 1/2008 | Baiton | |
| 2008/0087427 | A1 | 4/2008 | Kaminsky et al. | |
| 2009/0260811 | A1 | 10/2009 | Cui et al. | |
| 2009/0288827 | A1 | 11/2009 | Coskuner | |
| 2010/0181069 | A1 | 7/2010 | Schneider et al. | |
| 2010/0224370 | A1 | 9/2010 | Donnelly et al. | |
| 2011/0000666 | A1 | 1/2011 | Couto | |
| 2011/0120710 | A1 | 5/2011 | Dong et al. | |
| 2011/0127036 | A1 | 6/2011 | Tilmont et al. | |
| 2011/0227349 | A1 | 9/2011 | Huber et al. | |
| 2011/0297374 | A1 | 12/2011 | Kuhlman et al. | |
| 2013/0341015 | A1 * | 12/2013 | Tilmont | E21B 36/02 166/256 |

OTHER PUBLICATIONS

Written Opinion of the International Searching Authority, Application No. PCT/US2014/010834, dated Nov. 11, 2014, six (6) pages.

* cited by examiner

DOWNHOLE INJECTOR INSERT APPARATUS

CROSS-REFERENCE TO RELATED APPLICATIONS

This application claims priority to U.S. Provisional Patent Application Ser. No. 61/761,629, titled "Utilizing a Downhole Steam Generator System for Thermal Gas Lift," filed on Feb. 6, 2013, which is incorporated in its entirety herein by reference.

BACKGROUND

Artificial lift techniques are used to increase flow rate of oil out of a production well. One commercially available type of artificial lift is a gas lift. With a gas lift, compressed gas is injected into a well to increase the flow rate of produced fluid by decreasing head losses associated with weight of the column of fluids being produced. In particular, the injected gas reduces pressure on the bottom of the well by decreasing the bulk density of the fluid in the well. The decreased density allows the fluid to flow more easily out of the well. Gas lifts, however, do not work in all situations. For example, gas lifts do not work well with a reserve of high viscosity oil (heavy oil). Typically, thermal methods are used to recover heavy oil from a reservoir. In a typical thermal method, steam generated at the surface of the earth is pumped down a drive side well into a reservoir. As a result of the heat exchange between the steam pumped into the well and downhole fluids, the viscosity of the oil is reduced by an order of magnitude that allows it to be pumped out of a separate producing bore. A gas lift would not be used with a thermal system because the relatively cool temperature of the gas would counter the benefits of the heat exchange between the steam and the heavy oil therein, increasing the viscosity of the oil and negating the desired effect of the thermal system. The delivery of steam or other stimulation typically requires a major intervention or workover. During a workover, the completion is reconfigured to produce oil instead of injecting steam or vice versa reducing the time and, in turn, an amount of oil produced.

For the reasons stated above and for other reasons stated below, which will become apparent to those skilled in the art upon reading and understanding the present specification, there is a need in the art for an effective and efficient apparatus for delivering downhole steam or another supply of stimulation and/or fluid without a major intervention or workover.

BRIEF SUMMARY

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, an injector insert apparatus is provided. The injector apparatus includes a body having an inner oil passage configured and arranged to allow oil to pass therethrough, the body further having an annular chamber formed around the inner oil passage. The annular chamber has a chamber opening that is configured to be coupled to receive a flow of thermal gas medium. The body also has at least one injector orifice that provides a passage between the annular chamber and the inner oil passage. The at least one injector orifice is configured to inject the thermal gas lift medium into oil passing though the inner oil passage.

In another embodiment, a downhole system is provided. The system includes a Y-tool and an injector insert apparatus. The Y-tool is positioned to provide a path between a first portion of a production string and a second portion of the production string. The injector insert apparatus is positioned within the Y-tool. The injector insert apparatus has a body and an inner oil passage that is configured and arranged to allow oil to pass therethrough. The body further has an annular chamber formed around the inner oil passage. The annular chamber has a chamber opening that is configured to be coupled to receive a flow of thermal gas medium from a second wellbore. The body also has at least one injector orifice that provides a passage between the annular chamber and the inner oil passage. The at least one injector orifice is configured to inject the thermal gas medium into the inner oil passage.

In still another embodiment, a method of stimulating oil production for an oil reserve is provided. The method includes: delivering a high velocity thermal gas medium to an annular chamber that surrounds an oil passage in a first well; and injecting the thermal gas medium through at least one injector orifice into an oil flow passing through the oil passage.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout the figures and the specification.

DETAILED DESCRIPTION

Figure 1:
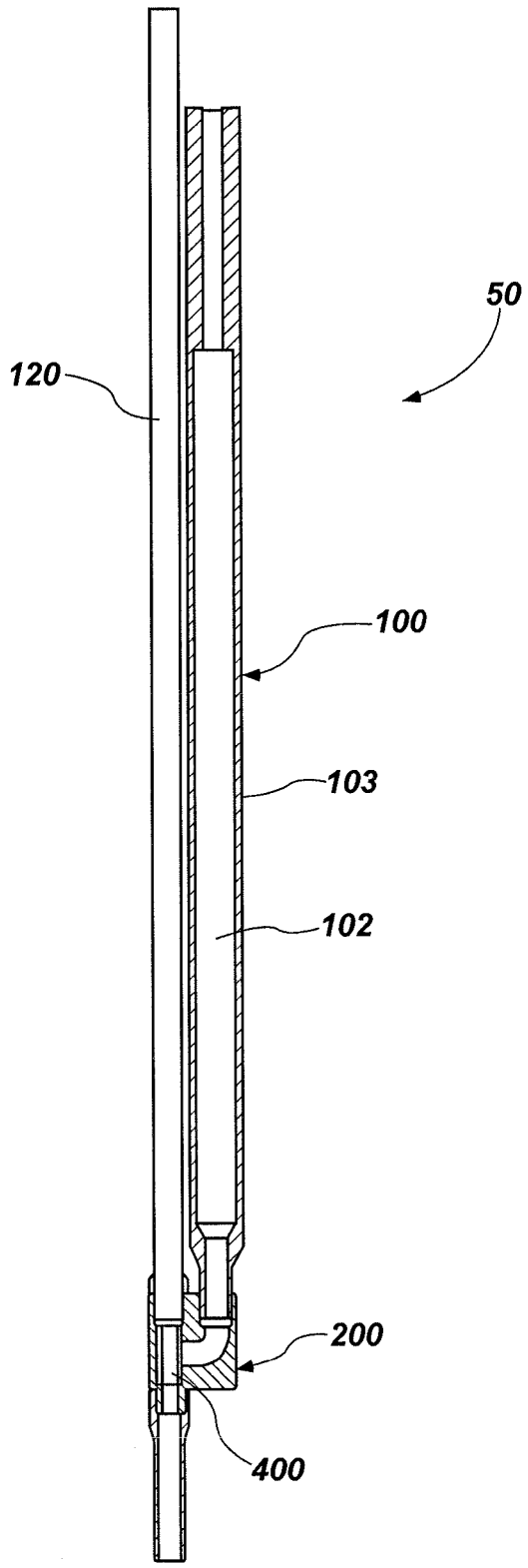
FIG. 1 is a schematic side sectional view of a downhole system of one embodiment of the present invention.

In the following detailed description, reference is made to the accompanying drawings, which form a part hereof and in which is shown by way of illustration, specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

In an embodiment, an annular diverging/converging nozzle comprising an injector insert is installed into a Y-tool at the exit of a steam generator or other hot fluid generator. The annular nozzle redirects the flow of gas to be parallel to the oil production and will act as a downhole ejector pump by transferring momentum to the oil being produced. In another embodiment, the nozzle exit of the pump will be injected into the flow at a slight angle. The injection will be upstream of a diverging contour of the nozzle. The injected flow of the motivating medium will self-choke to a Mach number less than 1.

Moreover, embodiments of the present invention provide an injector insert apparatus that forms a downhole jet pump with a gas source. The invention increases production of a well, as an artificial lift device and enables the production of oil around a downhole steam generator such as a heat exchanger. In an embodiment, a downhole steam generator is a combination of a combustor and a direct contact heat exchanger. An example of a combustor is found in the commonly assigned U.S. patent application Ser. No. 13/782,865, titled "HIGH PRESSURE COMBUSTOR WITH HOT SURFACE IGNITION," filed on Mar. 1, 2013, which is incorporated herein. An example of a heat exchanger is found in commonly assigned U.S. patent application Ser. No. 13/793,891, titled "HIGH EFFICIENCY DIRECT CONTACT HEAT EXCHANGER," filed on Mar. 11, 2013, which is herein incorporated by reference. The heat exchanger, in embodiments, may be cooled with either a liquid, e.g., water (steam mode), propane, or various hydrocarbons or other fluids such as CO, $CO_2$, $N_2$, etc. In an embodiment, the direct contact heat exchanger takes high-temperature, high-pressure exhaust from a downhole combustor and injects the gaseous effluent into water to create steam, which is a stimulation medium generally described as a "thermal gas medium." In other embodiments, as discussed above, the cooling matter can be used such as propane, or various hydrocarbons or other gases such as CO, $CO_2$, $N_2$, etc., that mix with the exhaust gases of the combustor to form the thermal gas medium. Hence, the matter supplied by the heat exchanger will generally be referred to as the thermal gas medium. Embodiments of an injector insert apparatus with a nozzle is installed in a Y-tool that redirects flow of the thermal gas medium from the heat exchanger going into the well to going out of the well. Thus, the nozzle functions as an ejector as discussed below. In an embodiment an annular nozzle is used, performing work on the oil being pumped by transferring momentum and lowering the static pressure at the exit of the nozzle. The bulk flow will then be increased by the lift properties of the gaseous mixture to further increase production. The injection insert apparatus allows the ability to stimulate a well and produce from the same well without a major workover, which presents a significant cost savings and increases efficiency.

Referring to FIG. 1, a downhole system 50 of one embodiment is illustrated. In an embodiment, the downhole system 50 includes a combustor and heat exchanger 100, as discussed above, which are positioned along side of the production string 120 in the same well. The combustor and heat exchange system 100 can generally be referred to as a hot fluid supply system 100 that supplies the thermal gas medium. The hot fluid supply system 100 is illustrated as having an outer housing 103 that protects inner components 102. The downhole system 50 further includes a Y-tool 200 which provides a path to the production string 120. Oil is to be extracted from the production string 120. Within the Y-tool 200, is installed an injector insert apparatus 400 of an embodiment.

Figure 2:
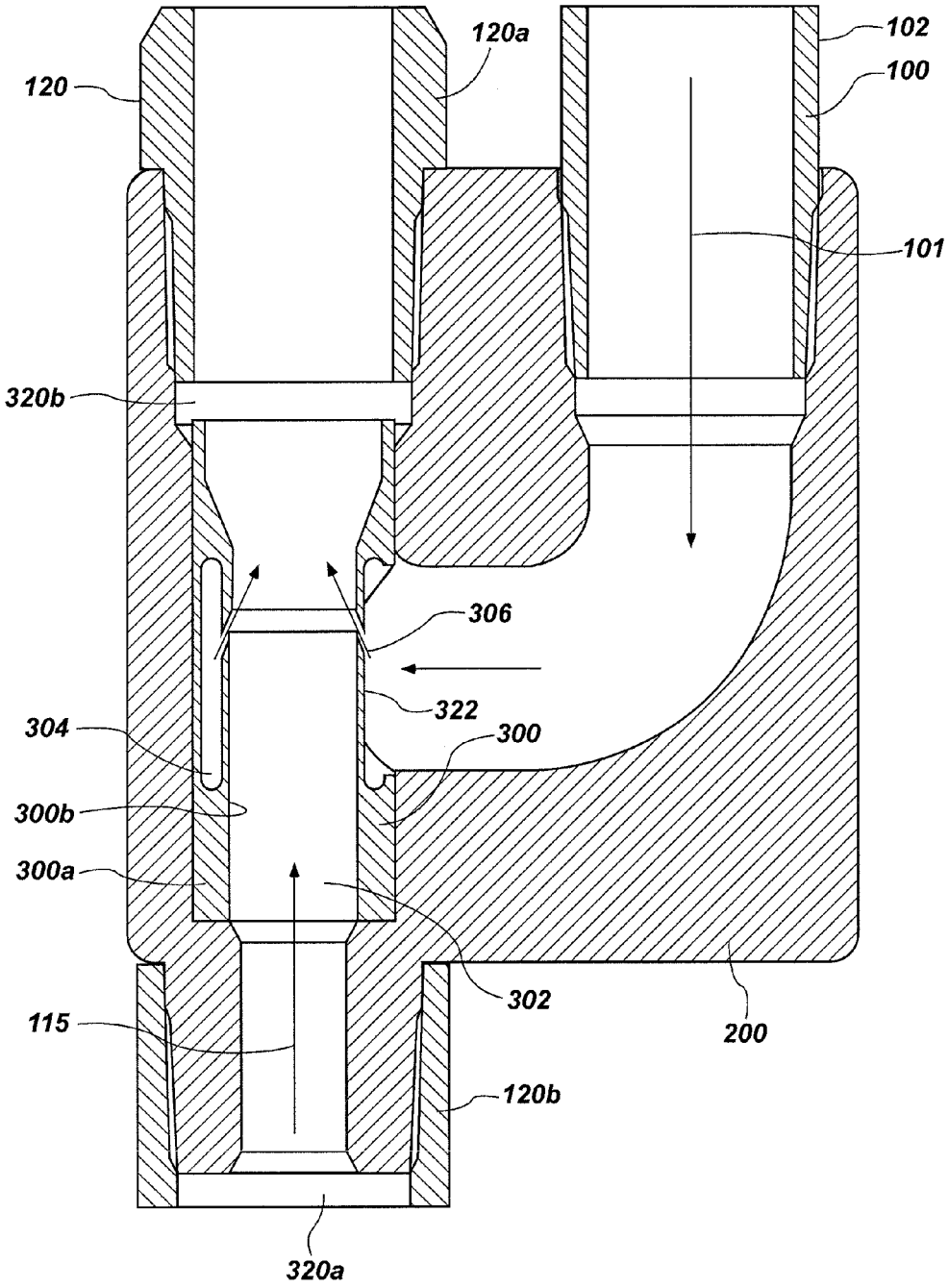
FIG. 2 is a close-up side sectional view of a nozzle assembly insert of one embodiment of the present invention.

FIG. 2 illustrates a close-up view of the Y-tool 200 with an injector insert apparatus 300 of an embodiment. The injector insert apparatus 300 includes an elongated annular body 300*a* that includes an inner oil passage 302 that provides a pathway between an upper portion 120*a* of the production string 120 that leads to the surface and a lower portion 120*b* of the production string 120 that leads to an oil reservoir. The annular body 300*a* has a first end 320*a* that may be positioned toward an oil reservoir and an opposed, second end 320*b* that may be positioned toward a well head. The annular body 300*a* further includes an annular chamber 304 (annular plenum) that is formed in the annular body 300*a* of the injector insert apparatus 300. The annular chamber 304 extends around the inner oil passage 302. The annular chamber 304 has an opening 322 that is in fluid communication with the Y-tool 200 to receive a thermal gas lift medium 101 from the hot fluid supply system 100. A narrow ejector orifice 306 (annular injector) between the annular chamber 304 and the inner oil passage 302 provides a path for the thermal gas lift medium 101 into the oil 115 in the inner oil passage 302. As illustrated, the ejector orifice 306 (an annular injector orifice in this embodiment) is configured to direct the thermal gas lift medium 101 up toward the surface, in this embodiment. The ejector orifice 306 is also positioned proximate the second end 320*b* of the injector insert assembly 300, in this embodiment. The thermal gas lift medium 101 entering the oil 115 will perform work on the oil 115 being pumped out of the well by transferring momentum and lowering static pressure at the exit of the nozzle. The bulk flow will then be increased by the lift properties of the gaseous mixture to further increase production.

In particular, the thermal gas medium 101, such as hot gas from the hot gas supply system 100 is delivered to the annular chamber 304 (annular plenum) at a pressure sufficient to allow the thermal gas medium 101 to reach high velocity. In some configurations, the velocity will be sonic and in other configurations it will be subsonic velocity. The thermal gas lift medium 101 is accelerated through the injector orifice 306 such that static pressure downstream of the injection point is reduced, thus, increasing the driving potential of the reservoir fluid. The final velocity of the stimulated thermal gas lift medium 101 and, in turn, the maximum momentum that can be imparted to the hydrocarbon stream is dictated by the geometry of the annular injection, as well as an effective annulus created between a contour of a wall making up an internal surface 300*b* of the injector insert apparatus 300 and the hydrocarbon fluid being pumped. In this instance, an outer boundary is fixed and defined by the geometry of the injector insert apparatus 300, while an inner boundary is defined by the discontinuity of densities between the hydrocarbon stream and the hot fluid.

Figure 3:
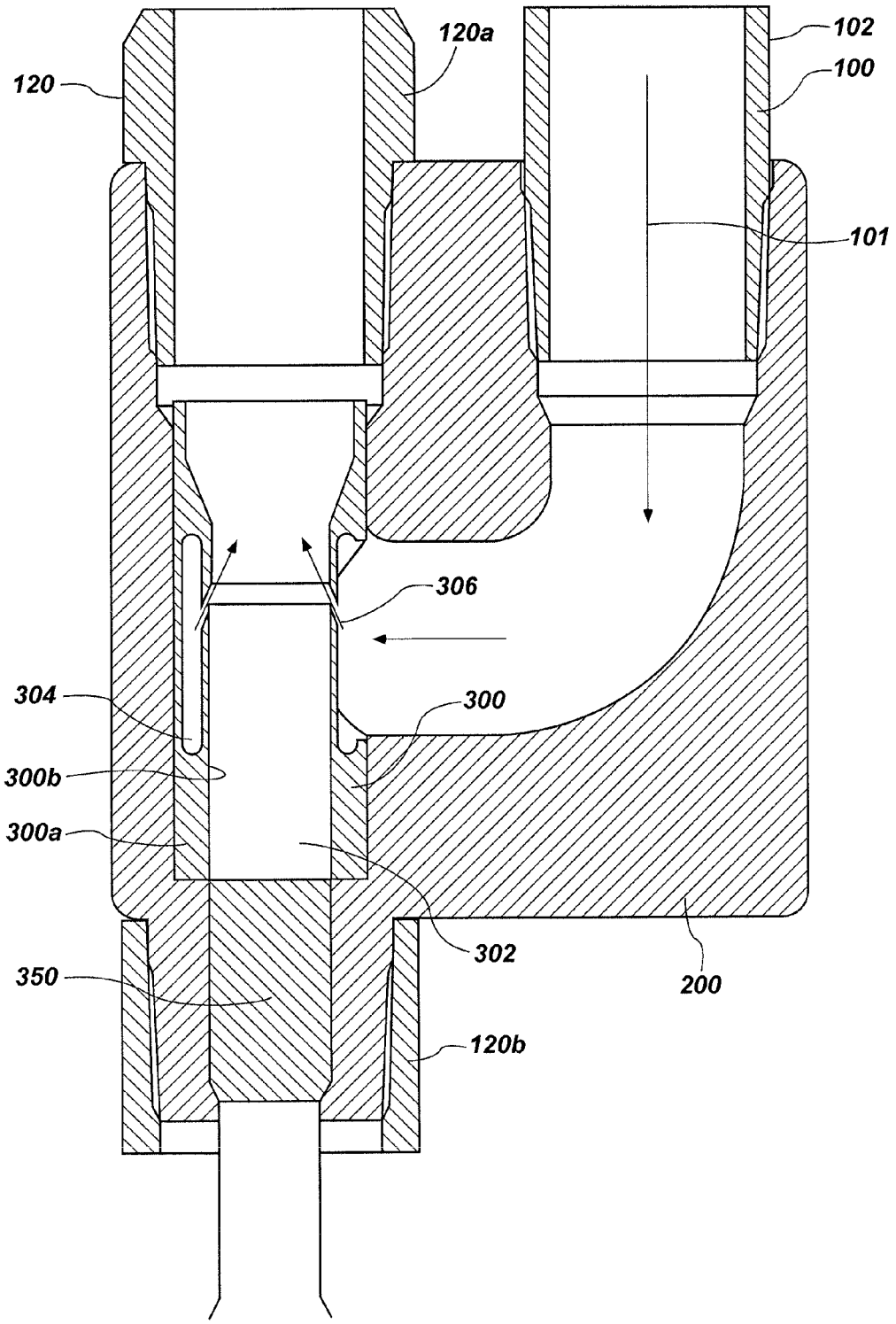
FIG. 3 is a close-up side sectional view of the nozzle assembly insert of FIG. 2 and a positioning of a plug in one embodiment of the present invention.
Figure 4:
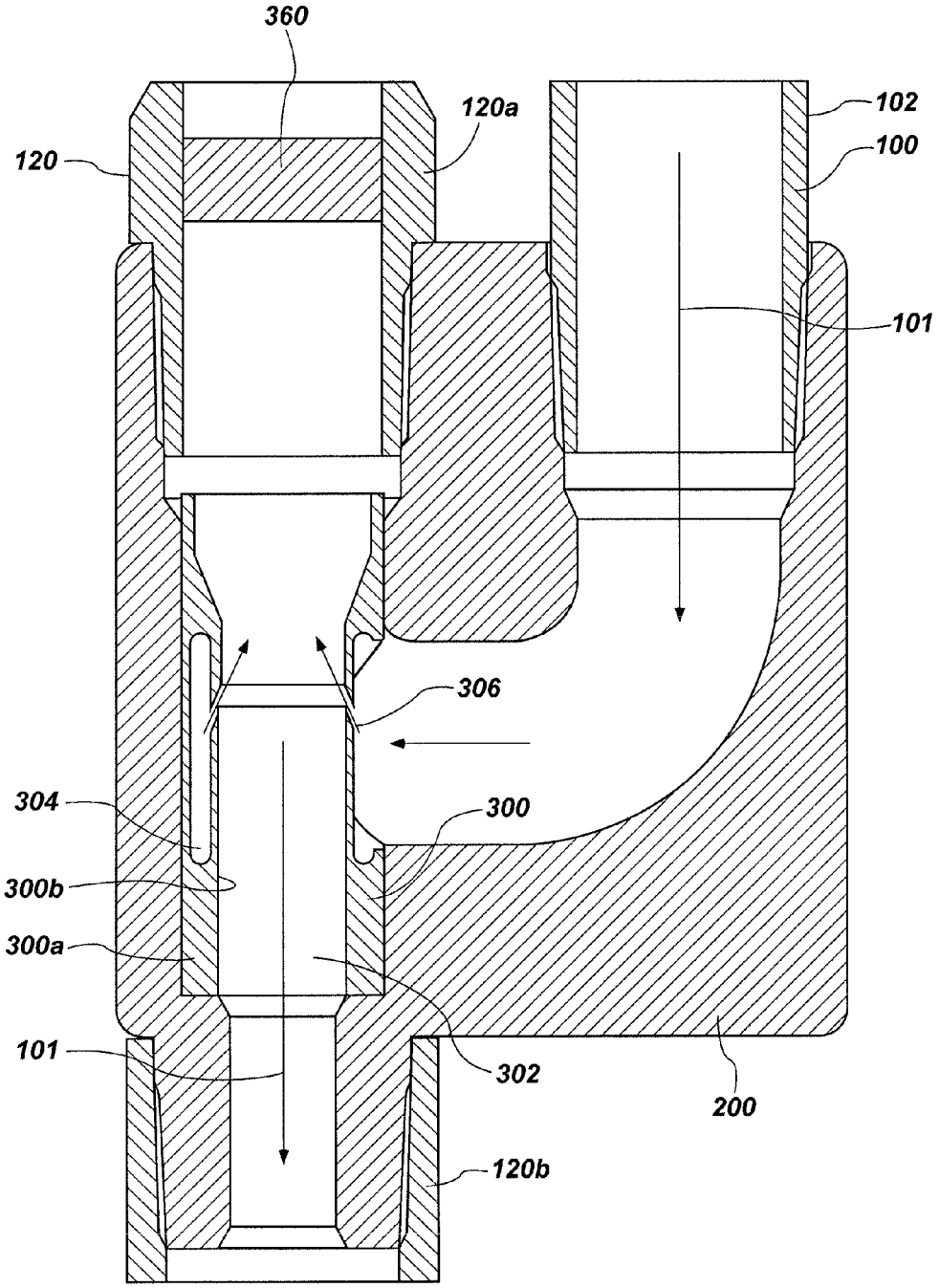
FIG. 4 is a close-up side sectional view of the nozzle assembly insert of FIG. 2 and the positioning of a plug in another location in another embodiment of the present invention.

The injector insert apparatus 300, with the inner oil passage 302, of embodiments allows for plugs to be inserted either above the injector insert apparatus 300 or below the injector insert apparatus 300. For example, referring to FIG. 3, a plug 350 has been passed through the inner oil passage 302 and positioned below the narrow ejector orifice 306. The plug 350, in this position, isolates the oil reservoir from the surface and the nozzle assembly injector insert apparatus 300 can be removed prior to stimulation of the reservoir and serviced prior to the next production period. This allows for faster and less expensive maintenance, as well as longer and more robust performance between major overhauls. The plug 350, in this position, also prevents the oil 115 from entering the hot gas supply system 100 when it is not in operation during the soak period of cyclic steam stimulation or CSS. FIG. 4 illustrates, a plug 360 positioned above the narrow ejector orifice 306. In this configuration, the output of the hot gas supply system 100 is allowed to flow downhole into the oil in the oil reservoir. This allows the hot gas to stimulate the oil in the reserve. As demonstrated with other cyclic steam stimulation production methods, dramatic increase of oil is exhibited with thermal stimulation. Certain operational metrics may dictate when the injector insert apparatus 300 was left in the Y-tool 200 during a CSS, as shown in FIG. 4, and when it would be best to remove the injector insert apparatus 300 before stimulating the oil reservoir, as shown in FIG. 3.

Figure 5:
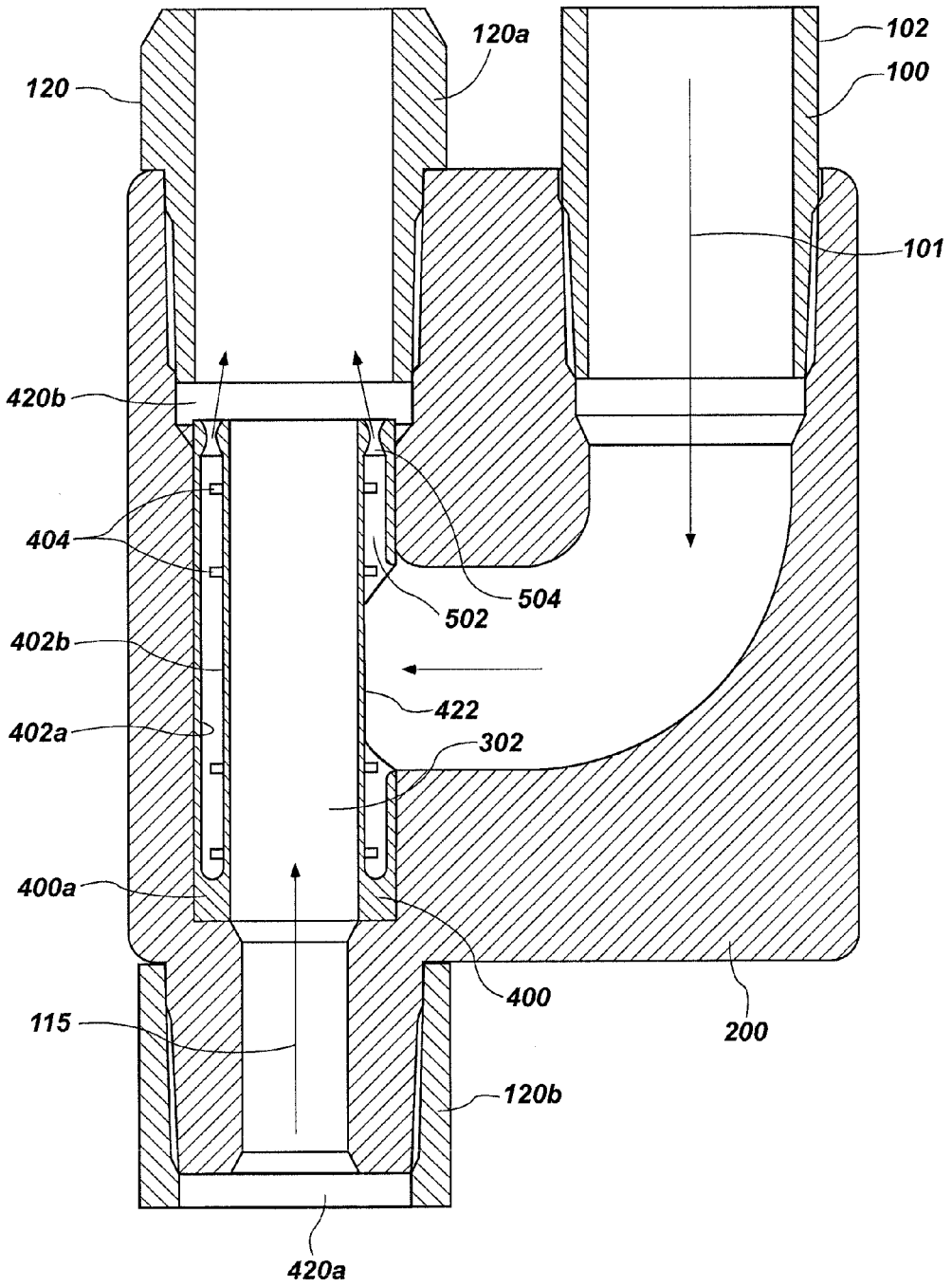
FIG. 5 is a close-up side sectional view of another embodiment of a nozzle assembly insert.

A different embodiment of an injector insert apparatus 400 is illustrated in FIG. 5. In this embodiment, an annular chamber 502 (an outer hot gas passage) is designed to accelerate the thermal gas medium 101 before the thermal gas medium 101 is expelled through narrow orifice 504 into the flow of oil in the upper well portion 120*a*. In this embodiment, acceleration of the thermal gas medium 101 occurs within the annular chamber 502. Injector insert apparatus 400 includes an elongated annular body 400*a* that includes an outer wall 402*a* and an inner wall 402*b*. The annular chamber 502 is formed between the outer wall 402*a* and the inner wall 402*b*. Further in this embodiment, spaced protrusions 404 extend from the inner wall 402*b* into the annular chamber 502. The protrusions 404 act as structural supports for the inner wall 402*b* and can enhance heat transfer from hot fluid to a hydrocarbon stream. The body 400*a* has a first end 420*a* that is positioned toward an oil reserve and an opposed, second end 420*b* positioned toward a surface. The narrow orifice 504 is positioned proximate the second end 420*b* of the body 400*a*. Also illustrated in FIG. 5, is a chamber opening 422, which allows the thermal gas lift medium 101 to enter the annular chamber 502.

Although specific embodiments have been illustrated and described herein, it will be appreciated by those of ordinary skill in the art that any arrangement, which is calculated to achieve the same purpose, may be substituted for the specific embodiments shown. For example, although the above embodiments show a fixed geometry, variations of the injector apparatus insert 300 can incorporate a variable minimum area, which would allow for substantial ratios of "steaming flow" to "motivating flow." Other variations include delivering a motivating fluid and pressure below which a sonic velocity is created in the annular injector orifice, and discrete injection holes spaced circumferentially around an inner cylinder of the injector insert apparatus 300. Hence, this application is intended to cover any adaptations or variations of the present invention. Therefore, it is manifestly intended that this invention be limited only by the claims and the equivalents thereof.

The invention claimed is:

1. A downhole system comprising:

a tubular production string comprising an upper portion and a lower portion;

a Y-tool configured and located to provide an oil flow path between the upper portion and the lower portion of the production string, the Y-tool including a branch passage extending laterally from the side of the Y-tool;

an injector insert apparatus positioned within the oil flow path of the Y-tool, the injector insert apparatus comprising a body having an oil passage for oil flow from the lower portion to the upper portion of the production string, the body further having an annular chamber extending around the oil passage, the annular chamber having an opening to the branch passage, and at least one injector orifice extending upwardly from the annular chamber to communicate with one of the oil passage or the oil flow path of the upper portion of the production string;

a combustor configured to generate high temperature, high pressure exhaust gases;

a heat exchanger operably coupled to the combustor to receive and cool the high temperature, high pressure exhaust gases with a fluid to form a thermal gas medium, the heat exchanger operably coupled to an inlet of the branch passage of the Y-tool.

2. The downhole system of claim 1, wherein the body has a first end and an opposed second end, the first end positioned toward the lower portion of the production string and the second end positioned toward the upper portion of the production string, the at least one injector orifice positioned to inject the thermal gas medium toward the second end of the body.

3. The downhole system of claim 1, wherein the annular chamber is shaped to accelerate the thermal gas medium before the thermal gas medium is expelled out the at least one injector orifice.

4. The downhole system of claim 1, further comprising at least one protrusion extending from a wall of the body into the annular chamber.

5. The downhole system of claim 1, further comprising a plug configured and positioned to selectively plug the oil flow path of the Y-tool below the injector insert apparatus.

6. The downhole system of claim 1, further comprising a plug configured and positioned to selectively plug the oil flow path of the production string above the injector insert apparatus.

7. The downhole system of claim 1, wherein the at least one injector orifice is oriented parallel to the oil passage.

8. The downhole system of claim 1, wherein the at least one injector orifice is oriented at a slight angle to the oil passage.

9. The downhole system of claim 1, wherein the at least one injector orifice is located upstream of a diverging portion of the oil passage.

10. The downhole system of claim 1, wherein the at least one injector orifice is annular.

11. A method of stimulating oil production from an oil reservoir, the method comprising:

generating high pressure, high temperature exhaust gases from a combustor in a wellbore;

cooling the high pressure, high temperature exhaust gases in a heat exchanger in the wellbore operably coupled with the combustor with a fluid to form a high velocity thermal gas medium;

delivering the high velocity thermal gas medium through a branch passage of a Y-tool in the wellbore to an annular chamber surrounding an oil passage through the Y-tool extending between a lower portion and an upper portion of a production string in the wellbore in communication with an oil reservoir; and injecting the thermal gas medium upwardly from the annular chamber through at least one injector orifice into a flow of oil from the reservoir through the oil passage.

12. The method of claim 11, further comprising:

passing a plug through the oil passage to a position below the at least one injector orifice block oil flow from the reservoir.

13. The method of claim 12, further comprising inserting an injector insert apparatus into the Y-tool through the upper portion of the production string and removing the plug.

14. The method of claim 11, wherein the oil passage, annular chamber and at least one injector orifice are located in a body comprising an injector insert apparatus received in the Y-tool, and further comprising removing the injector insert apparatus from the Y-tool through the upper portion of the production string after blocking oil flow from the reservoir.

15. The method of claim 11, further comprising passing a plug through the upper portion of the production string to a position above the at least one injector orifice to block the production string above the at least one injector orifice and direct the thermal gas medium into the lower portion of the production string.

* * * * *